US009095958B2

(12) United States Patent
Schmidt

(10) Patent No.: US 9,095,958 B2
(45) Date of Patent: Aug. 4, 2015

(54) SELF CENTERING DUAL DIRECTION CLAMPING VISE

(75) Inventor: David L. Schmidt, Zimmerman, MN (US)

(73) Assignee: Kurt Manufacturing Company, Inc., Minneapolis, MN (US)

( * ) Notice: Subject to any disclaimer, the term of this patent is extended or adjusted under 35 U.S.C. 154(b) by 0 days.

(21) Appl. No.: 13/534,439

(22) Filed: Jun. 27, 2012

(65) Prior Publication Data

US 2014/0001692 A1 Jan. 2, 2014

(51) Int. Cl.

| | |
|---|---|
| ***B25B 1/04*** | (2006.01) |
| ***B25B 1/10*** | (2006.01) |
| *B25B 1/12* | (2006.01) |
| *B25B 1/24* | (2006.01) |
| *B25B 1/00* | (2006.01) |

(52) U.S. Cl.

CPC ..... *B25B 1/103* (2013.01); *B25B 1/2405* (2013.01); *B25B 1/00* (2013.01); *B25B 1/12* (2013.01); *B25B 1/2473* (2013.01)

(58) Field of Classification Search

USPC ..... 269/136

See application file for complete search history.

(56) References Cited

U.S. PATENT DOCUMENTS

| | | | | | |
|---|---|---|---|---|---|
| 3,051,473 | A | * | 8/1962 | Juhase | 269/95 |
| 3,397,880 | A | * | 8/1968 | Kuban | 269/240 |
| 4,043,547 | A | * | 8/1977 | Glomb et al. | 269/136 |
| 4,413,818 | A | * | 11/1983 | Lenz | 269/81 |
| 4,685,663 | A | * | 8/1987 | Jorgensen | 269/244 |
| 4,898,371 | A | * | 2/1990 | Mills et al. | 269/136 |
| 4,928,937 | A | | 5/1990 | Bernstein | |
| 4,934,674 | A | | 6/1990 | Bernstein | |
| 5,098,073 | A | | 3/1992 | Lenz | |
| 5,163,662 | A | * | 11/1992 | Bernstein | 269/136 |
| 5,649,694 | A | * | 7/1997 | Buck | 269/43 |
| 5,698,867 | A | | 12/1997 | Bauer et al. | |
| 6,012,712 | A | | 1/2000 | Bernstein | |
| 6,017,026 | A | | 1/2000 | Durfee, Jr. | |
| 6,032,940 | A | * | 3/2000 | Wolfe | 269/279 |
| 6,053,490 | A | * | 4/2000 | Berchtold | 269/43 |
| 6,062,553 | A | | 5/2000 | Strehl | |
| 6,079,704 | A | | 6/2000 | Buck | |
| 6,139,001 | A | | 10/2000 | Buck | |
| 6,164,635 | A | * | 12/2000 | Chase et al. | 269/244 |
| 6,244,580 | B1 | | 6/2001 | Durfee, Jr. | |
| 6,773,003 | B2 | * | 8/2004 | Dermody, Jr. | 269/282 |
| 7,163,201 | B2 | * | 1/2007 | Bernstein | 269/32 |
| 8,152,175 | B1 | | 4/2012 | Maro et al. | |
| 2006/0049566 | A1 | * | 3/2006 | Bernstein | 269/43 |

* cited by examiner

*Primary Examiner* — Lee D Wilson
*Assistant Examiner* — Alvin Grant
(74) *Attorney, Agent, or Firm* — Steven M. Koehler; Westman, Champlin & Koehler, P.A.

(57) ABSTRACT

A vise assembly has a pair of moveable jaws mounted on guideways for movement toward and away from each other. The moveable jaws are driven by a vise screw on the vise body through head members of a pair of jaw nuts. The head members fit into cavities on the underside of the moveable jaws and have projections on first ends that have surfaces engaging mating recessed surfaces formed on one end of the cavities. Adjustable plungers are mounted on the head members and are extendable outwardly from a second end of the head members to engage and drive against surfaces of the cavities in a second direction. The adjustable plungers are adjustable in length so they can be retracted into mounting bores in the head members so the moveable jaws can be mounted on and removed from the head members, and extended so driving surfaces of projections on the head members and of the plungers are both in engagement with surfaces of the cavities.

20 Claims, 9 Drawing Sheets

SELF CENTERING DUAL DIRECTION CLAMPING VISE

BACKGROUND OF THE DISCLOSURE

The present disclosure relates to a self-centering vise that has two moveable jaws mounted on a base, and driven by a single actuating screw to move together or separate, depending on the direction of screw rotation to provide work piece holding force in both directions of jaw movement. The jaws have clamping faces on opposite sides thereof and can be used for clamping internal surfaces of a work piece or conventional clamping of a work piece on external surfaces. A jaw nut is provided with a jaw engaging drive that ensures down pressure on the vise jaws in either direction of clamping movement.

The use of self-centering jaws on vises has been known, and for example, U.S. Pat. No. 5,649,694 illustrates a vise that can be used without fixed jaws for reaction, and can clamp work pieces between the moveable jaws.

The use of single screws for moving two jaws simultaneously toward and away from each other is also known in the prior art, for example in U.S. Pat. No. 4,934,679.

The vise of the present disclosure has the ability to provide clamping with self-centering moveable jaws in either direction of movement of the jaws, that is moving together or expanding, and has a drive which provides adequate down pressure on the jaw support or guideway surface of the vise body, to provide adequate holding or clamping forces.

SUMMARY OF THE INVENTION

The present invention relates to a machine vise that has a vise body and as shown, a pair of moveable jaws that are mounted for sliding movement along suitable support surfaces or guideways on the vise body. A single actuator screw with opposite hand or lead threads for the respective jaws, or other convenient drive, moves jaw nuts. Each jaw nut has a head member that extends into a recess or cavity in the associated moveable jaw. The head member has a projection seated in a groove or recess on a first clamping wall of the respective jaw formed by the cavity, with a tapered drive surface on the projection facing the guideways and engaging a mating drive surface of the groove for driving the jaw in one direction. Each jaw nut also carries an adjustable jaw drive member or plunger that has an end portion that is seated in a groove or recess on a second opposite clamping wall of the respective jaw formed by the cavity and has a tapered drive surface engaging a mating drive surface formed on the groove in the second clamping wall, for driving the jaw in an opposite direction. The drive surfaces that engage between the jaw nut and the respective moveable jaw are angled to provide a downward force on the jaw to urge the jaw toward the jaw guideway in either direction of movement of the jaw. The adjustable jaw drive member in each jaw is linearly adjustable so as to ensure that there is engagement between the jaw nut and the respective moveable jaw in either direction of movement of the jaws. The adjustable jaw drive member is retractable so the projections of the head members can be moved to clear the surfaces of the cavities when the head members are inserted into the cavities for assembly.

A single jaw nut and moveable jaw using the drive for clamping in opposite directions also can be used with a vise body that has fixed jaws at one or both opposite ends of the vise base, with the moveable jaw in the center portions of the vise body.

DETAILED DESCRIPTION OF PREFERRED EMBODIMENTS

Figure 1:
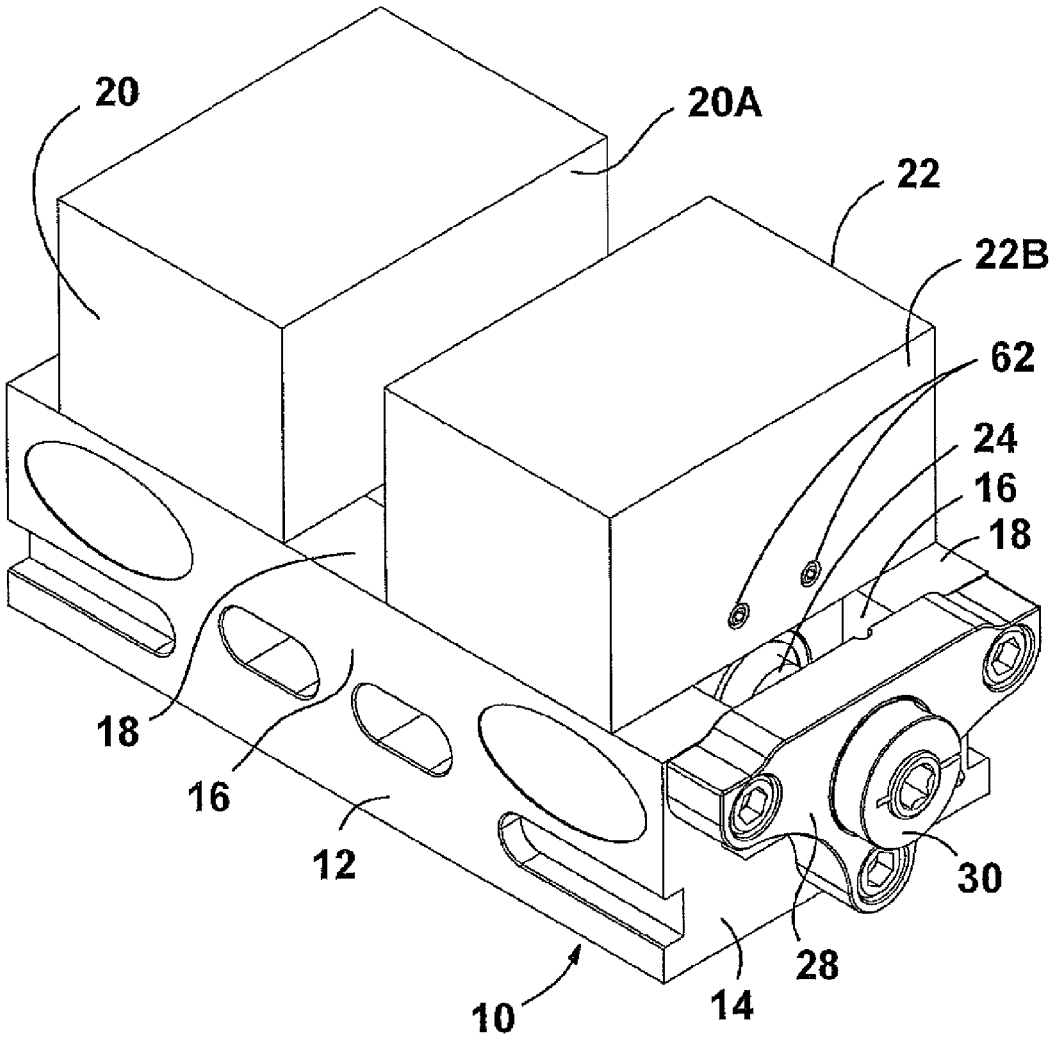
FIG. 1 is a perspective view of a self-centering dual direction clamping device or vise made according to the present invention.

The self-centering vise assembly indicated at 10 includes a vise body 12. The vise body 12 has a base 14, and a pair of spaced apart vise side rails 16 that extend upwardly from the base 14 and have upper surfaces indicated at 18 that form jaw support ways or guideway surfaces for slidably mounting and supporting a first moveable jaw 20 and a second moveable jaw 22. The jaws 20 and 22, as shown, have lower support surfaces that are supported on both of the guideways, and slide along the guideways.

The jaw 20 has a first clamping surface 20A and a second clamping surface 20B. The second jaw 22 has a first clamping surface 22A and a second clamping surface 22B. The clamping surfaces 20A and 22A face each other, and the clamping surfaces 20B and 22B are facing outwardly toward the opposite ends of the vise body 12. The clamping surfaces are shown as being planar and perpendicular to the plane of the guideway surfaces 18, but the clamping surfaces could be carved or sculpted to mate surfaces of a piece part to be clamped.

A vise screw or other jaw drive 24 is positioned in a recess formed between the vise side rails 16 and base 14, and is supported on a vise screw support flange 28 for rotation, and is held in place axially on the flange 28 with suitable collars 30. A removable crank (not shown) is used for rotating the vise screw 24. Thrust bearings can be provided between the flange and the collars as desired on opposite sides of the flange 28. The flange 28 is secured to an end of the vise body 12.

The vise screw 24 drives a first jaw nut 34 and a second jaw nut 36, which are threadably mounted on threaded sections of the vise screw 24. The vise screw 24 has a first threaded section 24A for driving the first jaw nut 34, and a second threaded section 24B for driving the second jaw nut 36, which threaded sections are separated at the center portion of the vise screw, and are of opposite hand or opposite lead. This means that when the vise screw 24 is rotated the jaw nuts will either move together or apart, depending on the direction of rotation of the screw. A hydraulic or electric linear actuator or actuators can be used for driving the jaw nuts simultaneously in opposite directions.

Each of the moveable jaws is provided with a recess or cavity on an underside thereof facing toward the guideway surfaces 18 and toward the base 14 of the vise body, which is considered downwardly. The cavities open to the support surfaces of the moveable jaws. The first moveable jaw 20 has a recess or cavity 20C, and the second moveable jaw 22 has a recess or cavity 22C, both open in direction toward the surfaces 18. The jaw nut 34 has an integral head member 34A that extends up into the cavity 20C of the first moveable jaw 20. The jaw nut 36 has an integral head member 36A that extends up into the cavity 22C of the second moveable jaw 22. The cavities 20C and 22C form chambers receiving the head members of the jaw nuts.

The cavity 20C forms opposite end wall portions 20F and 20G, adjacent the clamping surfaces 20A and 20B, respectively. The cavity 22C forms opposite end wall portions 22F and 22G, adjacent the clamping surfaces 22A and 22B, respectively. Interior surfaces of the end wall portions 20F, 20G, 22F, and 22G form ends of the cavities that receive the head members of the respective jaw nut. The end wall portions 20F and 20G have transverse "V" shaped grooves 20H and 20K formed therein, respectively (see FIGS. 5-8). The end wall portions 22F and 22G have transverse "V" shaped grooves 22H and 22K formed therein, respectively.

Figure 2:
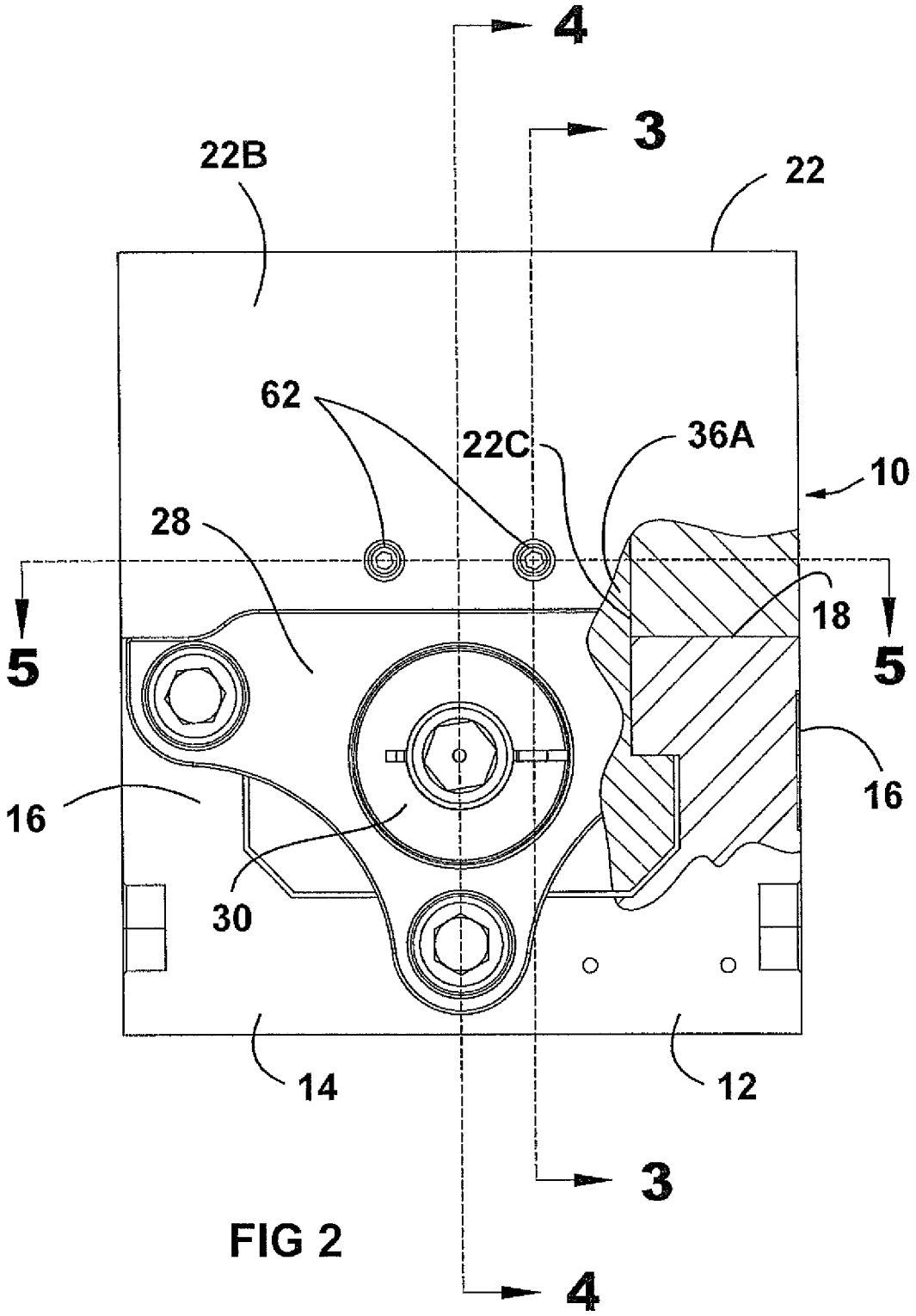
FIG. 2 is an end view of the device of FIG. 1, with parts in section and parts broken away.

Each of the head members 34A and 36A of the jaw nuts 34 and 36 has machined side surfaces that fit between side surfaces of the top part of the vise side rails 16, and also fit between the side surfaces of the cavities 20C and 22C respectively, as shown typically in the broken away part on one side of the vise in FIG. 2, to control the side play of the moveable jaws. The jaw nuts also have side rails that fit under overhanging portions of the top parts of vise rails 16 to control the lifting of the jaw nuts relative to the vise side rails, as shown in FIG. 2.

Each of the head members 34A and 36A also is shaped to include a drive projection 34B and 36B, respectively, at the end of the head member facing the end wall portions 20F and 22F, and thus at the end adjacent the clamping surfaces 20A and 22A. Each of the drive projections 34B and 36B is formed to fit in grooves 20H and 22H (with clearance) respectively, and each drive projection has a downwardly facing tapered drive surface 34C and 36C, respectively that are made to mate with and engage a corresponding upwardly facing driven surface 20D and 22D formed in the respective end wall portion 20F and 22F of the respective cavity adjacent the clamping surfaces 20A and 22A that face each other when mounted on the vise base.

The driven surfaces 20D and 22D are formed by machining the "V" shaped grooves 20H and 22H in the end wall portions 20F and 22F of the respective moveable jaw formed by the recesses or cavities 20C or 22C.

It can be seen that the head members 34A and 36A have an axial length (in direction along the axis of the vise screw) shorter than the axial length of cavities 20C or 22C into which the head members extend so the head members will fit into the respective cavity as explained below. Each head member is provided with a pair of separate spaced apart bores 34D and 36D, each of which receives an identical plunger assembly 40. The plunger assemblies 40 will be identically numbered and are mounted in the respective head member 34A and 36A in the provided bores. Each of the plunger assemblies comprises an adjustable member and includes a plunger housing or sleeve 42 that is slidably mounted in the respective bore 34D or 36D, and each of the plunger housings 42 has an outer end projection portion that is formed to fit, with clearance, within grooves 20K and 22K. The outer end projection portion of the plunger housing 42 has a tapered surface comprising a downwardly facing drive surface 44 that mates with driven surfaces 20E or 22E in the respective grooves in the end wall portions 20G or 22G of the moveable jaws 20 and 22. The outer end projecting portion or end of the housing 42 is generally V-shaped, as shown, and each plunger can be retracted into the bore in which it fits, and also lengthened. The respective surfaces 44 and 20E and 22E engage for driving the respective moveable jaw in direction to separate.

Figure 6:
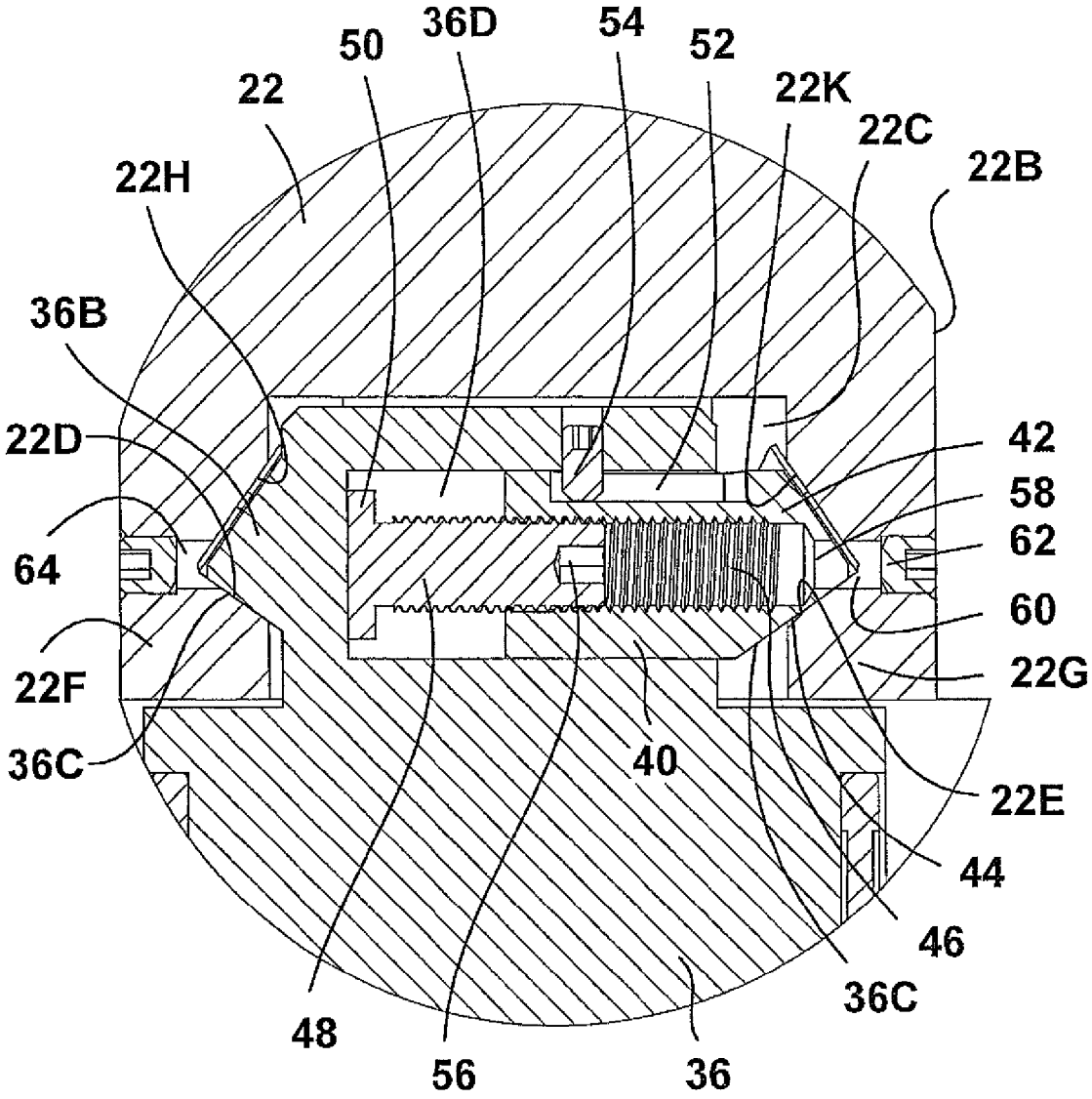
FIG. 6 is an enlarged sectional view of a drive between a jaw nut and a moveable jaw.
Figure 7:
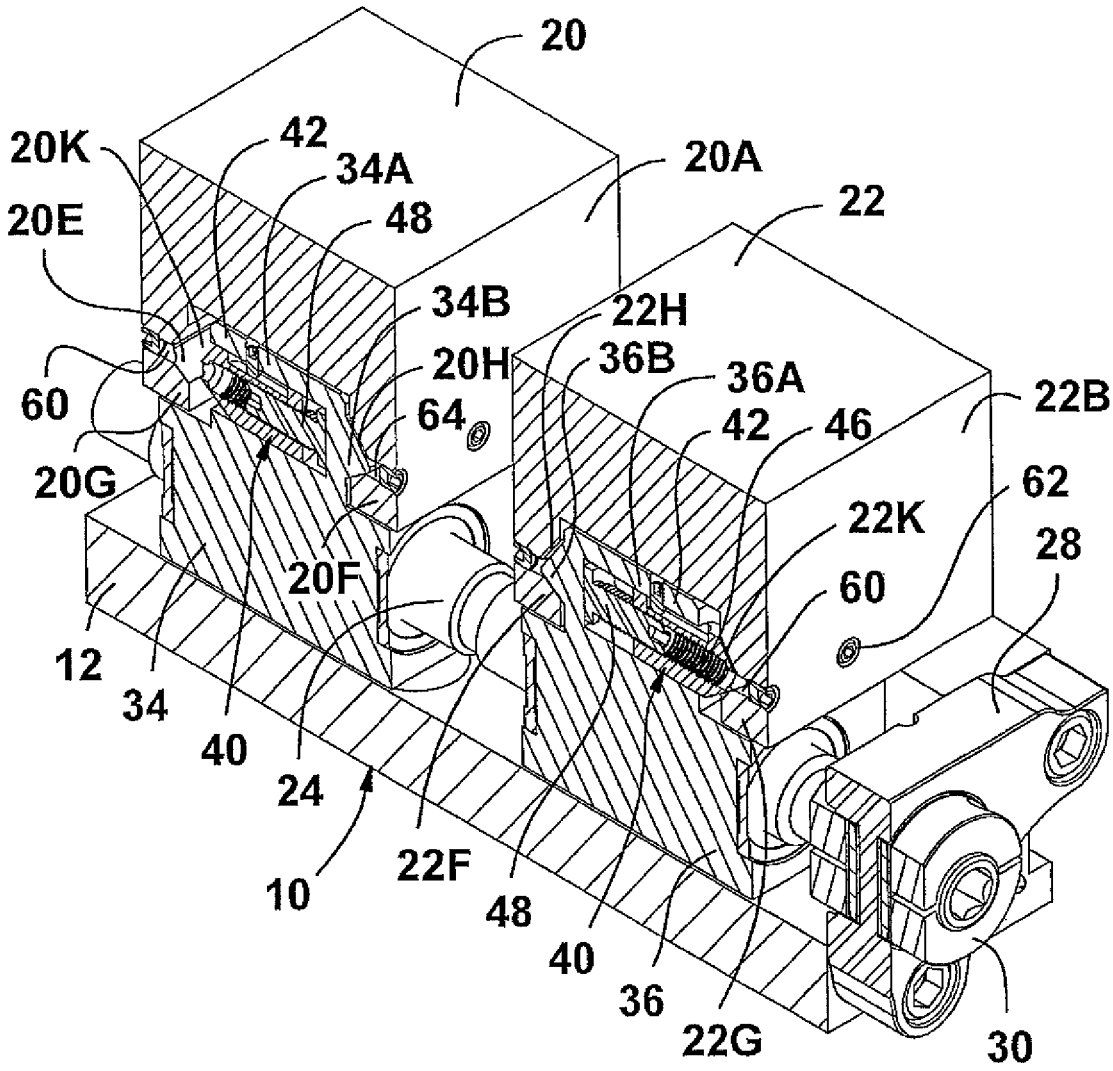
FIG. 7 is a sectional perspective view of the vise of FIG. 1 showing moveable jaws mounted on an actuating screw, with the left jaw drive or plunger partially retracted.

The plunger housing 42 is a sleeve and has an interior threaded bore 46 that threadably receives a plunger screw 48 that fits within the respective bore 34D and 36D of the associated jaw nut. The plunger screw has a head 50 that bears against the interior end of the respective bore 34D and 36D. The overall length of the plunger assembly or adjustable member 40, from the head 50 to the end of tip of the driving surface 44 can be varied by threading or rotating the plunger screw 48 relative to the plunger housing 42. Each of the plunger housings 42 also has an external groove 52 that is engaged by a set screw 54 threaded through the wall of the respective head portion 34A and 36A, in line with the bores 34D and 36D, to keep the plunger housings 42 from rotating about their axes in the bores. The set screws 54 keep the surfaces 44 properly positioned to drive against surfaces 20E and 22E. The plunger housings 42 will, however, slide along the bores 34D and 36D while restrained from rotating by the setscrew 54 sliding in the grooves 52. The plunger screw 48 of the plunger assembly 40 has an internal hex shaped socket 56 at the inner end of the screw, that is aligned with a bore 58 in the outer end of the respective plunger housing 42. When the plungers are in position as shown in FIG. 6, the opening 58 aligns with a bore 60 in the wall portion 20G or 22G of the respective moveable jaw. The bores 60 can be plugged with a set screw 62, which is removable as will be explained. The wall portions 20F and 22F also have bores 64 aligned with the grooves 20A and 22A for inserting a probe or tool to loosen the projections 34B and 36B for disassembly. A set screw also can be used to close bores 64.

In assembling a jaw nut and associated moveable jaw, the lengths of the two plunger assemblies 40 used in each moveable jaw are shortened by threading the plunger screws 48 into the threaded bores 46 so that the outer end portions of the plunger housings having the drive surfaces 44 will be retracted sufficiently (entirely in the mounting bores) so that the rear surface of the head member and the end of the respective drive projections 34B or 36B of the respective moveable jaw head member will clear the interior surface of the end wall portion 20F and 22F of the respective cavity, 20C or 22C. The surfaces of the moveable jaw head members at the end opposite from the projections 34B and 36B are spaced from the interior surfaces of the end wall portions 20G and 22G when the jaw nuts are in working position, as shown in FIGS. 3 and 6, for example, and that spacing in the cavities permits backing the projections of the jaw nut head members out of the grooves 20K and 22K, when the plunger assemblies are retracted, to provide clearance for the projections when the moveable jaws are placed on or removed from the respective jaw nut head member.

For assembly, the respective movable jaw can be placed over the associated jaw nut head member and the head member 34A or 36A will fit into the cavity 20C or 22C of the respective moveable jaw. When the moveable jaw is in place over the respective head member, the drive projection 34B or 36B can be seated into the associated groove 20H or 22H against the respective surface 20D or 22D. To adjust the length of each plunger assembly 40, the hex shaped cross section shaft of an Allen wrench is inserted through the bores 60 and 58 and through the interior of the threaded bore 46 and into the hex socket 56 of the screw of the plunger assembly being adjusted, to thread or rotate the plunger screw 48 to extend the overall length of the plunger assembly until the drive surface 44 engages and bears against the driving surface 20E or 22E, and the drive surface 34C or 36C of the projection 34B or 36B of the respective head member is snuggly fitting against the driven surface 20D or 22D of the respective moveable jaw.

Figure 3:
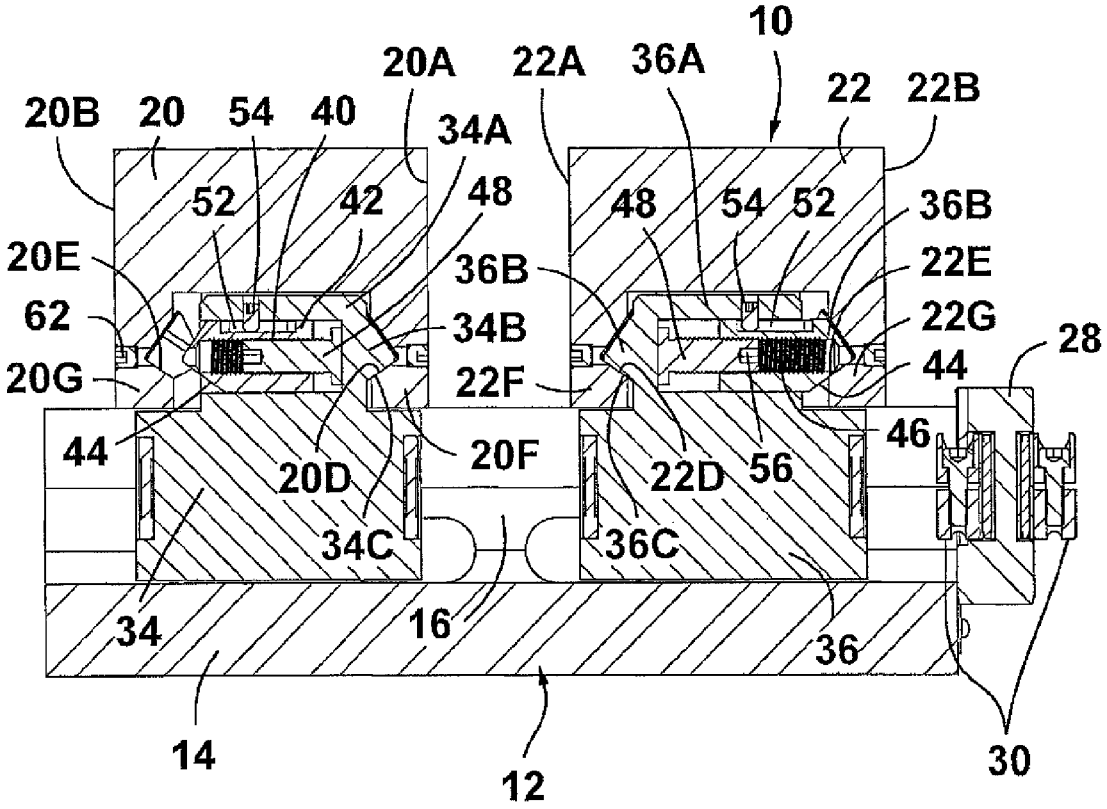
FIG. 3 is a sectional view taken on line 3-3 in FIG. 2, with a jaw drive member or plunger on the left moveable jaw retracted.
Figure 4:
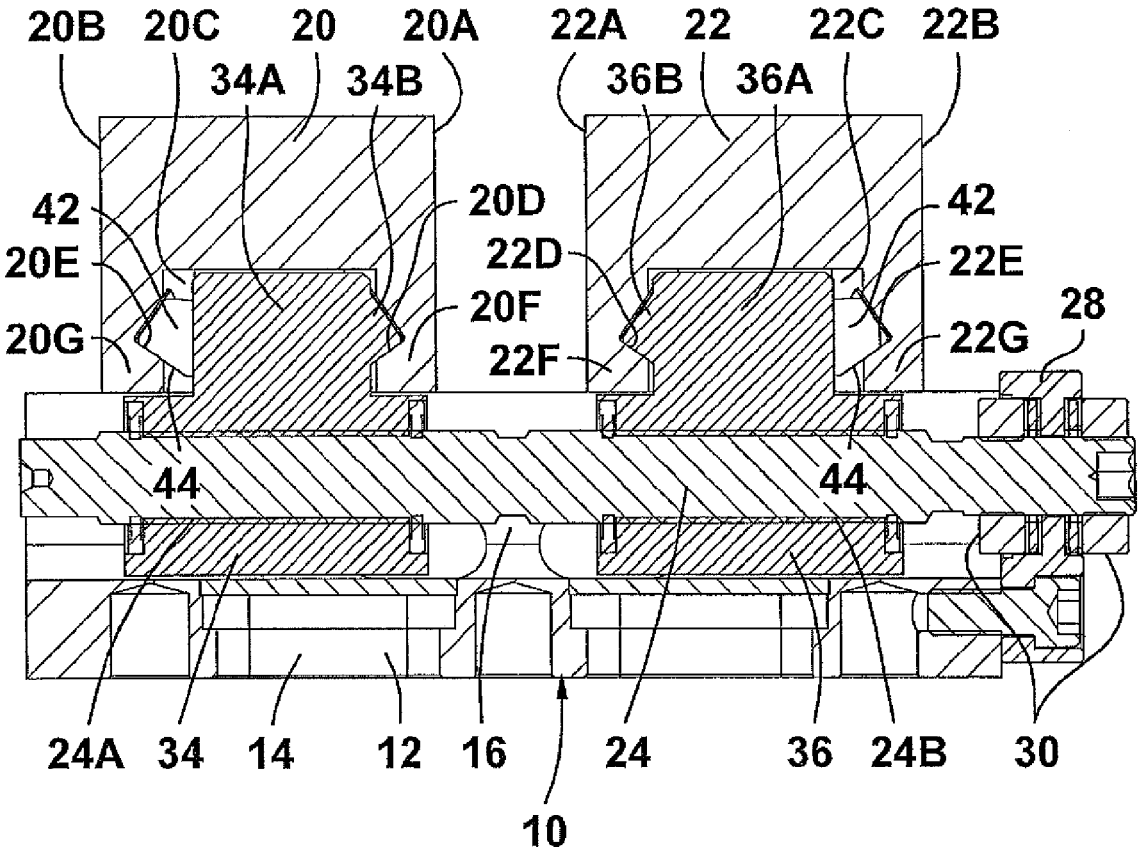
FIG. 4 is a sectional view taken as on line 4-4 in FIG. 2.
Figure 5:
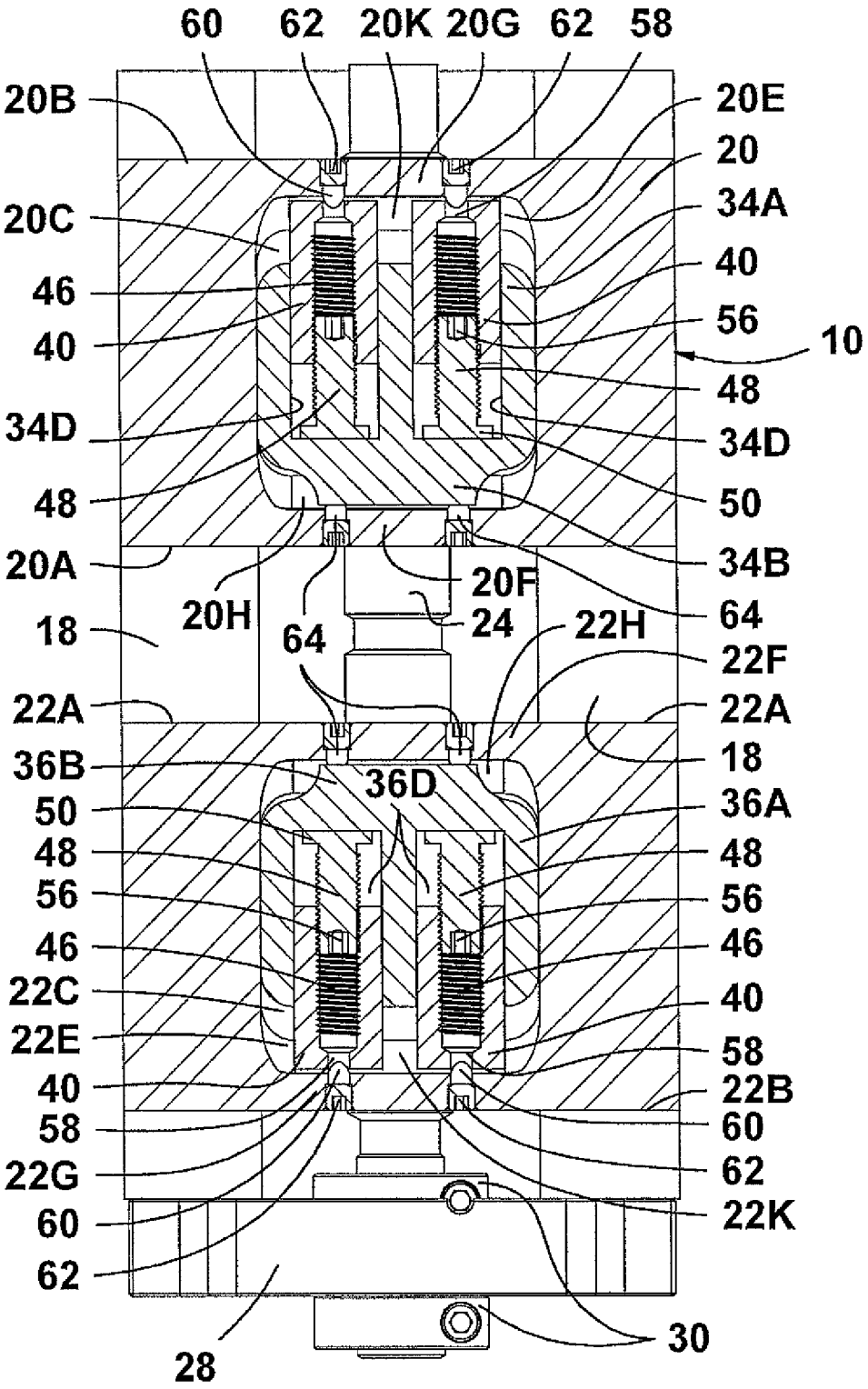
FIG. 5 is a sectional view taken on line 5-5 in FIG. 2 with dual jaw drive members or plungers of the moveable jaws engaged.
Figure 8:
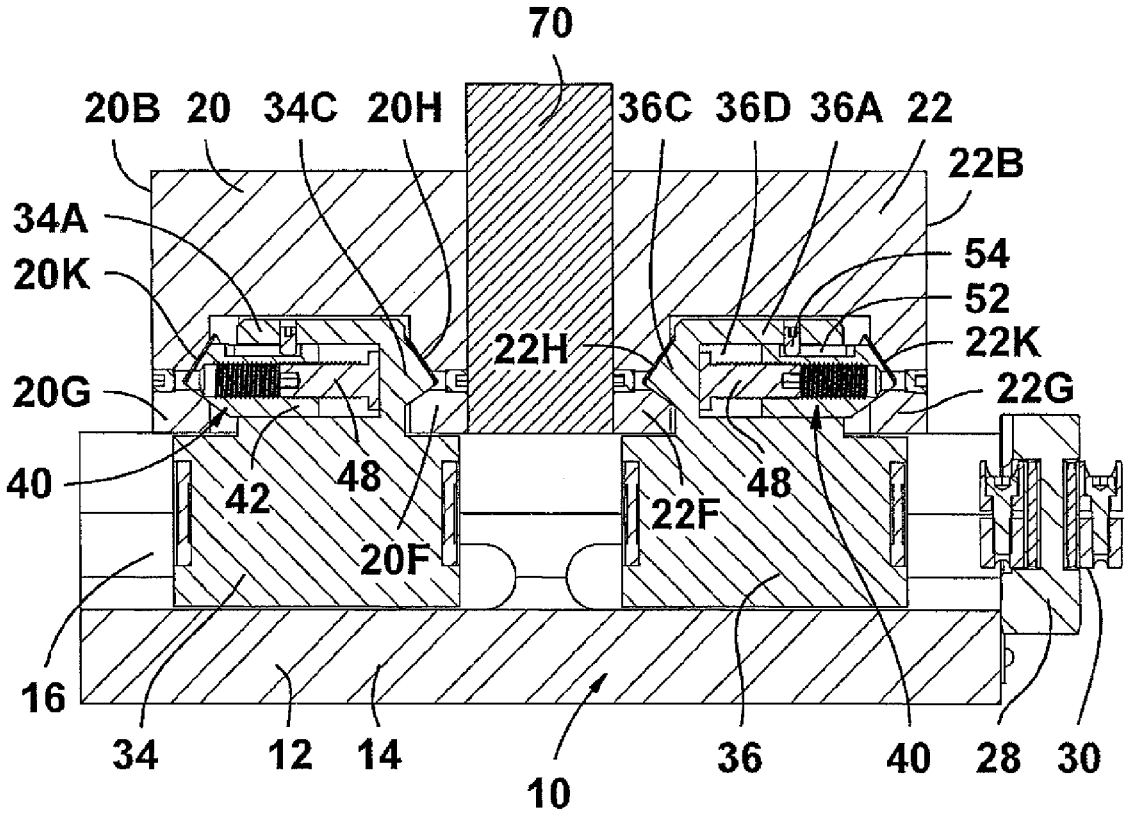
FIG. 8 is a sectional view taken on line 3-3 showing a work piece clamped on exterior surfaces of the work piece.
Figure 9:
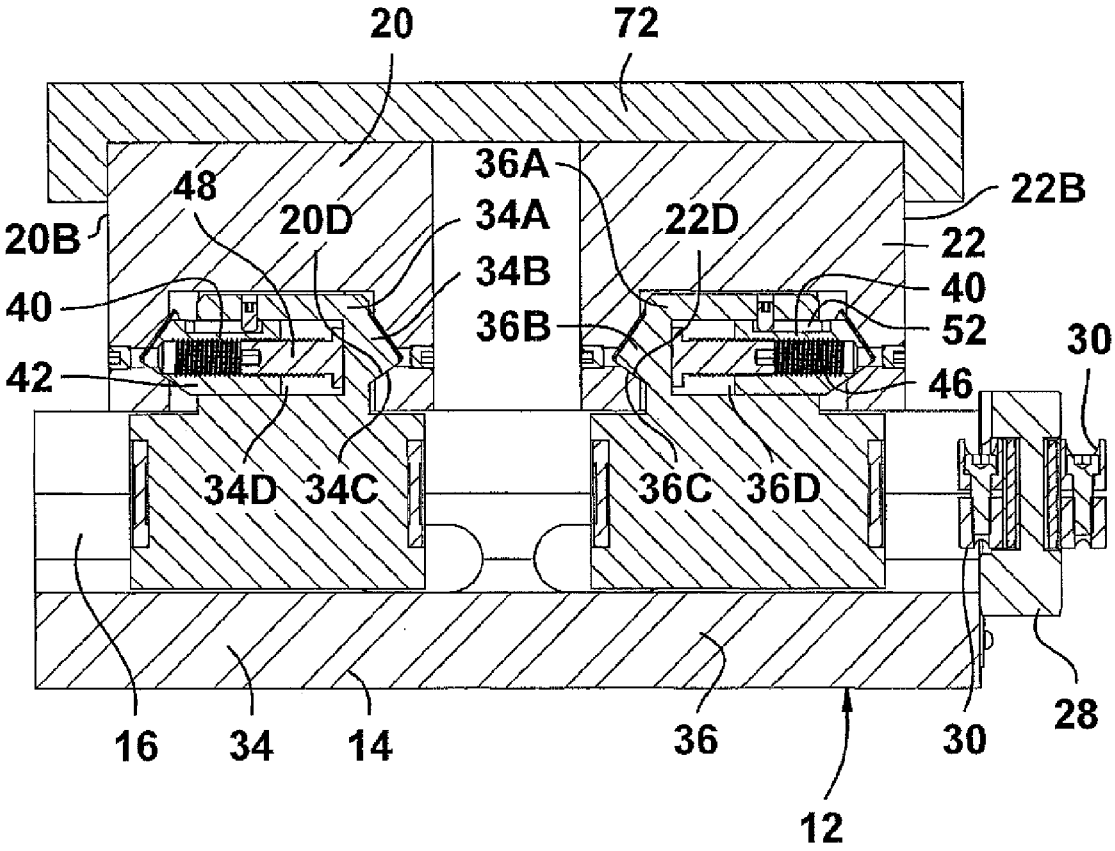
FIG. 9 is a sectional view taken on line 3-3 showing a work piece clamped on interior surfaces of the work piece.

When the movable jaws 20 and 22 are mounted as shown in FIG. 3 and FIG. 8, threading the vise screw 24 in a first direction will permit the facing surfaces 20A and 22A to clamp a work piece 70 between the facing surfaces, on the external surfaces of the work piece, as shown in FIG. 8. As shown in FIG. 9, if desired, a work piece 72 that has internal surfaces can be placed over the moveable jaws 20 and 22 and the vise screw 24 (shown in FIGS. 4 and 5) rotated in an opposite direction to separate the jaws under force, so that the clamping surfaces 20B and 22B will engage and securely hold the work piece 72 against the facing interior surfaces of such part. In either direction of clamping the drive on the moveable jaw provides a force to hold the moveable jaw against the guideway surface of the rails 16.

When a movable jaw is to be removed from its associated jaw nut, the plunger screw of each plunger assembly 40 can again be used to retract the plungers into the mounting bores, and the projections 34B and 36B backed out from the grooves 20H and 22H, so there is clearance for removal of the movable jaw.

The present structure provides for ease of assembly of the moveable jaws onto the respective jaw nut, and the ability to insure the jaw is securely and snuggly held in the jaw nut for operation in either direction of movement, and for applying adequate clamping forces in the selected direction of movement that is either on the interior surface of the work piece or on the exterior surface of the work piece.

The drive shown for the moveable jaw can be used with only one movable jaw, for clamping against fixed jaws at opposite ends of a vise body, with the moveable jaw between the fixed jaws. The clamping force is applied through angled surfaces that provides a force on the movable jaw toward the guideway surfaces.

The use of two laterally spaced plunger assemblies 40 on each moveable jaw applies force on opposite sides of the center line of the vise so the clamping surfaces of moveable jaws 20 and 22 are square with the longitudinal axis of the screw or the axis of the vise, by properly adjusting the plunger length. The plunger assembly bores, and the plunger assemblies 40 are on opposite sides of a plane perpendicular to the plane of guideway surfaces 18 and passing through the longitudinal axis of screw 24.

Although the present invention has been described with reference to preferred embodiments, workers skilled in the art will recognize that changes may be made in form and detail without departing from the spirit and scope of the invention.

What is claimed is:

1. A vise assembly comprising a vise body, a pair of moveable jaws mounted on guideways on said vise body for movement toward and away from each other, a vise screw on the vise body, a pair of jaw nuts, each jaw nut associated with one of the moveable jaws and threadably mounted on the vise screw, each of the jaw nuts having a head member, each moveable jaw having a recess defined in a side thereof facing the screw and guideways for receiving a respective head member, each head member having a projection on a first end with a first tapered driving surface facing the guideways, at least one adjustable plunger mounted on each head member, each adjustable member having a separate user operable member, each adjustable plunger selectively extendable outwardly from a second end opposite the first end of the head member and having a second tapered driving surface facing the guideways, and the recess in each moveable jaw being defined at least in part by first and second tapered driven surfaces facing away from the guideways and mating with the first tapered driving surface on the projection of the head member of the associated jaw nut and the second tapered driving surface of the adjustable plunger mounted on the head member of the associated jaw nut, the head member of each jaw nut being of size to fit within the recess of the associated moveable jaw, and each adjustable plunger and corresponding user operable member being configured to selectively adjust a length of the adjustable member with operation of the corresponding user operable member when the head member of the respective jaw nut is in the respective recess to move the first tapered driving surface of the projection of the respective head member into contact with the first tapered driven surface of the respective recess, and with the second tapered driving surface of the respective plunger in engagement with the second tapered driven surface of the respective recess.

2. The vise assembly of claim 1, wherein each adjustable plunger comprises a screw and a threaded sleeve, an outer end of the threaded sleeve having the second tapered driving surface of the adjustable plunger, each screw comprising the user operable member.

3. The vise assembly of claim 1 wherein each head member has a bore open to the second opposite end of the head member, the adjustable plunger of each head member being slidably mounted on the respective bore.

4. The vise assembly of claim 3 and a guide member mounted on the respective head member and slidably engaging a slot in the adjustable plunger in the respective bore to restrain rotation of the adjustable plunger in the respective bore.

5. The vise assembly of claim 1 wherein each head member has a pair of adjustable plungers mounted thereon, the pair of adjustable plungers being symmetrically positioned on opposite sides of a plane perpendicular to a plane of the guideways and passing through a rotational axis of the vise screw.

6. The vise assembly of claim 1 wherein each moveable jaw has a first clamping surface facing the other of the movable jaws, and a second clamping surface on a side of each movable jaw facing away from the other movable jaw.

7. A drive and mounting for a moveable vise, comprising a vise jaw nut having a head member, the moveable vise jaw configured to be driven by the vise jaw nut in first and second opposite directions, the moveable vise jaw having a support surface and having an opening leading to a cavity for receiving the head member of the vise jaw nut, the head member having a first side facing in the first direction and a bore, separate from the opening, extending from the cavity to an outer surface of the head member, the cavity having first and second surfaces spaced apart in the first and second directions, and an adjustable member mounted on the head member of the vise jaw nut and having an end extendable in the second direction from a second side of the head member, said adjustable member being adjustable in the first and second opposite directions, the adjustable member being configured to allow a user to adjust, via access to the adjustable member through the bore, a length of the adjustable member to engage the second surface of the cavity and to forcibly move the first side of the head member into engagement with the first surface of the cavity.

8. The drive and mounting for a moveable vise jaw of claim 7 further comprising grooves defined in the first and second surfaces of the cavities, respectively, and the first side of the head member having a projection engaging the groove in the first surface of the cavity and the adjustable member having an end engaging the groove in the second surface of the cavity when the adjustable member is changed in length to move the first side of the head member into engagement with the first surface of the cavity.

9. The drive and mounting for a movable vise jaw of claim 8, wherein the adjustable member is adjustable along an axis parallel to the first and second directions and wherein the bore extends from the cavity along the axis and through one of the grooves.

10. The drive and mounting for a movable vise jaw of claim 9 in combination with a vise body, the vise body having a guideway forming a support for the support surface of the moveable jaw, and a jaw drive for moving the jaw nut in opposite directions along the guideway, and wherein the vise body has a second jaw thereon that reacts clamping forces of the moveable jaw engaging a work piece in either of the opposite directions of movement of the jaw nut, wherein the second jaw is moved by the jaw drive in directions opposite from movement of the moveable jaw when the moveable jaw is moved by the jaw drive.

11. The combination of claim 7 wherein the adjustable member is adjustable along an axis parallel to the first and second directions and wherein the bore extends from the cavity along the axis.

12. The drive and mounting for a moveable vise jaw of claim 8 wherein the grooves in the first and second surfaces of the cavity are defined in part by tapered surfaces that face in direction away from the support surface of the moveable jaw, and the projection on the first side of the head member and the end of the adjustable member having tapered surfaces that face toward the support surface of the moveable vise jaw and mate with the tapered surfaces of the grooves in the first and second surfaces of the cavity.

13. A vise assembly comprising a vise body, a least one moveable vise jaw supported on a support surface of a guideway on said vise body for movement toward and away from a second vice jaw, a vise jaw drive on the vise body, a jaw nut associated with the moveable jaw and drivably connected to the vise jaw drive, the jaw nut having a head member, the moveable jaw having a cavity defined in a side thereof with an opening facing the support surface of the guideway for receiving the head member, the head member having a bore, separate from the opening, extending from the cavity to an outer surface, the head member having a projection on a first end thereof with a first tapered driving surface facing the support surface, an adjustable plunger mounted on the head member and extendable outwardly from a second opposite end of the head member which is opposite from the first end of the head member, the adjustable plunger having a second tapered driving surface facing the support surface, the cavity in the moveable vise jaw being defined at least in part by first and second tapered driven surfaces facing away from the support surface and mating with the first tapered driving surface on the projection of the head member of the jaw nut and the second tapered driving surface of the adjustable plunger mounted on the head member of the jaw nut, the head member of the jaw nut being of size to fit within the recess of the moveable vise jaw, and the adjustable plunger and the bore being configured so as to engage the adjustable member through the bore and adjust the adjustable plunger in length when the head member of the jaw nut is in the cavity to move the first tapered driving surface of the projection of the head member into contact with the first tapered driven surface of the cavity, and with the second tapered driving surface of the adjustable plunger in engagement with the second tapered driven surface of the cavity.

14. The vise assembly of claim 13, wherein the adjustable plunger comprises a screw and a threaded sleeve, the screw being threaded in the sleeve, an outer end of the threaded sleeve having the second tapered driving surface of the adjustable plunger.

15. The vise assembly of claim 13 wherein the bore is open to the second opposite end of the head member, the adjustable plunger being slidably mounted in the bore.

16. The vise assembly of claim 14 further comprising the second tapered driven surface being formed in a wall of the head member forming an end of the cavity, a hex shaped socket formed in an end of the screw threaded into the sleeve, the bore being through the wall of the head member and opening into the cavity, a second bore through the outer end of the sleeve aligned with the bore, the bores being of size to permit a hex shaped shaft of a wrench to be inserted through the bores to engage the hex shaped socket for adjusting the length of the adjustable plunger.

17. The vise assembly of claim 14 further comprising a guide member mounted on the head member and slidably engaging a slot in the sleeve of the adjustable plunger to restrain rotation of the adjustable plunger.

18. The vise assembly of claim 1 wherein each of the user operable members comprises a rotatable screw.

19. The vise assembly of claim 1 wherein each adjustable plunger comprises a rotatable screw and a threaded sleeve.

20. A vise assembly comprising a vise body, a pair of moveable jaws mounted on guideways on said vise body for movement toward and away from each other, a vise screw on the vise body, a pair of jaw nuts, each jaw nut associated with one of the moveable jaws and threadably mounted on the vise screw, each of the jaw nuts having a head member, each moveable jaw having a recess defined in a side thereof facing the screw and guideways for receiving a respective head member, each head member having a projection on a first end with a first tapered driving surface facing the guideways, two adjustable plungers mounted on each head member, each extendable outwardly from a second end opposite the first end of the head member and having a second tapered driving surface facing the guideways, and the recess in each moveable jaw being defined at least in part by first and second tapered driven surfaces facing away from the guideways and mating with the first tapered driving surface on the projection of the head member of the associated jaw nut and the second tapered driving surface of each adjustable plunger mounted on the respective head member of the associated jaw nut, the head member of each jaw nut being of size to fit within the recess of the associated moveable jaw, and each adjustable plunger being adjustable in length when the respective head member of the respective jaw nut is in the respective recess to move the first tapered driving surface of the projection of the respective head member into contact with the first tapered driven surface of the respective recess, and with the second tapered driving surface of the respective plunger in engagement with the second tapered driven surface of the respective recess, and wherein the pair of adjustable plungers of each head member are symmetrically positioned on opposite sides of a plane perpendicular to a plane of the guideways and passing through a rotational axis of the vise screw, each adjustable plunger comprises a rotatable screw and a threaded sleeve, each rotatable screw being aligned with a bore extending from the recess through the respective head member, the bore being of size to allow a tool to be inserted therein to engage and rotate the respective screw.

* * * * *